US007963027B2

(12) United States Patent
Du

(10) Patent No.: US 7,963,027 B2
(45) Date of Patent: Jun. 21, 2011

(54) METHOD OF MANUFACTURING A SWITCH DEVICE

(75) Inventor: Li Du, Dalian (CN)

(73) Assignees: Li Du, Xinjiang (CN); Xinhong Zhang, Xinjiang (CN)

( * ) Notice: Subject to any disclaimer, the term of this patent is extended or adjusted under 35 U.S.C. 154(b) by 0 days.

(21) Appl. No.: 11/479,552

(22) PCT Filed: Jan. 5, 2004

(86) PCT No.: PCT/CN2004/000012
§ 371 (c)(1),
(2), (4) Date: Sep. 19, 2006

(87) PCT Pub. No.: WO2005/066985
PCT Pub. Date: Jul. 21, 2005

(65) Prior Publication Data

US 2007/0008290 A1 Jan. 11, 2007

(51) Int. Cl.
*H01H 11/00* (2006.01)
*H01H 65/00* (2006.01)

(52) U.S. Cl. ..... 29/622; 29/825; 29/846; 345/157; 345/161

(58) Field of Classification Search ..... 29/622, 29/825, 842, 846, 854; 324/691; 345/156, 345/157, 161, 168; 347/168
See application file for complete search history.

(56) References Cited

U.S. PATENT DOCUMENTS

| | | | | |
|---|---|---|---|---|
| 5,481,263 | A | 1/1996 | Choi | |
| 5,516,991 | A | 5/1996 | Hommann | |
| 5,738,352 | A | 4/1998 | Ohkubo et al. | |
| 6,121,954 | A * | 9/2000 | Seffernick | 345/161 |
| 6,236,034 | B1 * | 5/2001 | DeVolpi | 250/221 |
| 6,867,601 | B2 * | 3/2005 | Morimoto | 324/661 |
| 7,064,561 | B2 * | 6/2006 | Morimoto | 324/691 |

FOREIGN PATENT DOCUMENTS

| | | |
|---|---|---|
| CN | 2082458 | 8/1991 |
| CN | 1264982 | 2/1999 |
| CN | 1221140 | 6/1999 |
| EP | 1 0224 600 | 6/1987 |
| JP | 6175761 | 6/1994 |

(Continued)

OTHER PUBLICATIONS

International Preliminary Report on Patentability; PCT/CN2004/000012; Jul. 10, 2006 and Written Opinion of the International Searching Authority.

(Continued)

*Primary Examiner* — Thiem Phan

(74) *Attorney, Agent, or Firm* — Beyer Law Group LLP

(57) ABSTRACT

A manufacturing method of a switch device having changeable distances involves uniformly arranging more than two throws on the same circumference and then fixing the throws onto corresponding circular carriers. Included further is fixing a number of throws on the inner cylinder surface of a flat cylinder plate body, and fixing the poles in cylinder shape on to the top of the carrier in a cap shape which can be worn on the tip of a single finger. One end of the lead wires is connected to respective throws and pole, the other end is connected to the pin of the interface of the controlled object by fixing or inserting in order to form the switch device. Distances between the throws and the poles are variable.

12 Claims, 2 Drawing Sheets

FOREIGN PATENT DOCUMENTS

WO WO 2005/066985 7/2005

OTHER PUBLICATIONS

International Search Report; PCT/CN2004/000012; Oct. 14, 2004.

CN Office Action Mar. 6, 2009; CPEL0555419N.090511.
Abstract of CN 1221140; 1 pg.
Abstract of CN 1264982; 1 pg.
Abstract of CN 2082458U; 1pg.
Abstract of JP 6175761; 1pg.

* cited by examiner

METHOD OF MANUFACTURING A SWITCH DEVICE

CROSS-REFERENCE TO RELATED APPLICATION

This application is the National Phase patent application of international application No. PCT/CN04/00012, filed on Jan. 5, 2004.

TECHNICAL FIELD

The present invention relates to a switch, more particularly, to a method of manufacturing a switch which can be used as a signal generating device to provide continuous real time response.

BACKGROUND ART

The conventional keystroke switch used in daily life and work is an integrated structure of a single pole and a single throw. The distance from the pole to the throw is constant when the pole is off the throw. During the contacting procedure, the pole makes unidirectional movement towards the throw. In a keypad utilizing such a switch, the constant distance from the pole to the throw and the unidirectional movement of the pole towards the throw determine a unidirectional and vertical movement of an operator's finger and the complexity of multi-finger operation, so a person's contact interface with the keys is mostly by fingertip. Only the fingertip is an easier and faster way for pressing keys. For people who touch keys frequently, this will restrict the degree of freedom of the five fingers on both hands, and even the whole body. A static single pose causes the operator to become tired easily and affects the efficiency and interest of the fingers, hands, body, eyes and brain. Since the pole and the throw are integrated together and the position of the pole relative to the throw is relatively constant, the operation of hands cannot be flexible and multidirectional, thus being unfavorable for the operator's adjustment and relaxation.

The Chinese patent application, of "Annularly-Arranged Mobile Keypad" application number of CN1264982A, filed by Liao, Hua Yong on Feb. 24, 1999 has disclosed a mobile keypad with single keystroke button and multiple keys. The keypad consists of a keystroke button and a number of keys annularly arranged around the keystroke button. The keystroke button is reset by a reset spring. During operation, the keys annularly arranged around the keystroke button are pressed by operating the keystroke button with a thumb so as to input numerals or perform functional operation. Although this invention employs a single keystroke button for operation, that being arranged annularly around the keystroke button are a number of switches (rather than a number of throws within one switch), so that each pole contacts and releases from each throw with a constant distance and a fixed direction. Furthermore, a spring reset is employed for the keystroke button, which adds a new feature of constant distance and fixed direction on the basis of the existing switch. This structure is still deficient regarding flexibility of operation.

The problem with which the prior art is confronted is to make the pole within a pole-throw combination have multidirectionality similar to a single finger movement. A pole in the prior art is bound by the rule of constant distance. The constant distance between the pole and the throw dictates that the finger's movement hinges on the direction and distance of the pole relative to the throw. For an operator, it is desirable that the pole moves with the finger and if necessary, the pole contacts the throw directly. By moving from a constant distance and fixed direction between the pole and the throw (when the pole is off from the throw as in the prior art), to a variable direction and distance between a finger and the throw a combination of the pole with the finger can achieve control over a synchronization action including the whole procedure of the pole's start, contact, and release. In this way, the problem concerning the stroke of the constant distance between the pole and the throw in the prior art can be overcome.

Another problem in the prior art concerns further reduction in key's size and an improvement of the operating sensitivity. There is a conflict between further minimization of the key's size in the keypad and the operating sensitivity and accuracy. The integrated structure of a single pole and a single throw leads to the usual key-in method with multiple fingers or a single finger; this input methods prevents minimization of the key's size due to ensuring the operating accuracy, and also prevents the further minimization of the input means such as keypad.

CONTENTS OF THE INVENTION

The technical problem the invention wants to resolve is to vary the direction of movement of the pole and the throw, namely the problem of constant distance between the pole and the throw in the switch of the prior art. If the pole and the throw are separated rather than integrated in terms of structure, i.e., the pole contacting and releasing from different throws, and varying direction as circumstances demand, the problem of constant and fixed direction in the prior art can be solved. The pole can be moved synchronously with the hand when the pole becomes a part or an extension of the finger, thereby avoiding the procedure that the operator feels for the pole in the switch with fingers and pushes the pole in a fixed direction to make the pole and the throw contact each other. This is easy for a single finger to move without seeing.

Since the pole is mounted on the top of a finger and the size of the throw itself is small, the size of the throw-tray containing the throw is reduced too; thus a miniature switch device can be realized.

The purpose of the invention is to provide a method of manufacturing a switch device which permits the pole to have a dynamic performance of changing the distance and direction relative to the throw before and after each time it contacts the throw, and allows it to move within a plane to which a handle of the pole is continuously vertical.

The manufacturing method consists of three steps. Firstly, there should be more than two throws arranged uniformly on the same circumference, the circumference including different levels on a carrier's inner cylindrical surface, an inner circular plane and the throw-carrier's outer surface. With the above conditions satisfied for the carrier holding the throws, except for the outer surface, it should also ensure that there is not any movement-resistant object, within the circumference, i.e., there should be a free space in the shape of a cylinder or circular plane. If the cylinder body is set upright more than two throws can be arranged uniformly on the bottom plane and on the cylindrical surface, except for the top surface, respectively. Thus, the carrier should be a concave object or an annular object, such as on the shape of a bucket or sheath. This is the space condition to ensure the pole's movement with changing direction and distance, and it is also the difference between the invention and the existing manual switches with movement-resistant objects. Here the throw tray can be made in a plate shape, annular sleeve shape, annular sheet shape, etc. The inner circular space within the plate and the annular sleeve is a flat cylinder. The inner circular space within the circular sheet is a circular plane. The carriers with throws arranged and fixed uniformly can be connected to other objects (including the pole carrier) by means of wedges, tendons or other joining method, with the purpose of easy deposit during non-operation or for positioning during operation. After the position of the carrier and the throws are set, the size of the throw depends upon the maximization of the interval between the two closest throws.

Secondly, let the pole be in a shape of a long cylinder body, or a hollow pipe and sections with insulation between each other but still integrated together. It should be ensured that the pole and its carrier can be moved synchronously with the finger, and be vertical to a plane when they move within the plane continuously. It is to unite with the barrier-free concave space of the throw carrier. Here the pole carrier employs an object that can be mounted on a single finger. Contrary to the hollow feature of the throw carrier, the space of the pole carrier should be fixed on the top of the finger. The carrier is in the shape of a cap or sheath, the cap top is spherical or a circular truncated cone. The pole can be fixed on any place of the outer circular surface as long as it is vertical to the surface and does not affect the convenience and ease of the finger's insertion and the operation of in and out. The length and diameter of the pole are determined by uniting and fitting with the throw position set by the circular space of the throw carrier, so the possibility that unwanted throws are touched by mistake is minimized. It is especially critical for the diameter, and it should be easy for it to be vertical to the plane on which the pole moves.

At last, the lead wires are fixed not only on the pole and the throw, but also on the carrier near the fixing point to avoid breakup. The other end is connected to the pin of the interface of the served object, or to the row and column lines wired in a matrix by fixing or inserting. There may be connection lines between throws, among one or more throw carriers. Poles can also be connected with lines for the convenience of using, like the equivalent keys on the keypad. Thus, it can be seen that by the interface of the controlled object fixed and connected on the other end of the lead wires, the pole and the throw are integrated together indirectly to form an integral switch device. It is also a difference of the present invention from the existing switches that integrates the carriers directly, or integrates the pole and the throw directly, e.g., keystroke, wheel toggle, push, and various kinds of plugs and sockets. Furthermore, the pole in the existing switch moves continuously with a constant distance and fixed direction, and there is not a linkage between the pole and the single finger. But the switch device of the present application is tailor-made and acts according to actual circumstances, unlike existing switches which have universality and interchangeability but result inevitably in a comparatively simple variety of products and manufacturing methods.

Furthermore, all elements of the switch device of the present application can be flexibly changed, added or removed according to practical use, and thus various structures, manufacturing methods and operating methods are derived. All these are for only one purpose i.e., the pole moves within a plane and is in a state of being vertical to the plane continuously, thereby resulting in a dynamic state in which the direction and distance between the pole and the throw are changed before and after each pole-throw contact. Variable elements include the structural shape, size, number of the poles, throws and the carriers, the positioning of the poles and the throws with respect to the carriers, the materials of the poles, throw and carriers, the number and fashion of the lead wires, the software definition for different kinds of pole-throw contact, etc.

The cylinder-shaped pole can be ensured to move spatially without any barrier within a plane, and thus certainly can be ensured to be inserted into and drawn out of the throw carrier. Thus, there is room for it to be always vertical to the circular plane, and for vertical movement at the same time. By utilizing such features the positioning of throws is not limited to a circle, but can be expanded to multiple levels on the cylinder surface. Thus multiple poles insulated from each other can move within the cylindrical space. A smaller pole is used to change its position vertically to achieve changing pole contacting throws at different levels of the circle, and thus more different kinds of pole-throw contacts are generated to fit for more operation circumstance. It is better to employ bottomless throw carrier in annular sleeve shape. Likewise, if the throws are to be placed on the outer surface of the throw carrier, including the outer circular surface, when operating, the pole can be drawn out of the inner circular space or otherwise the pole can contact the throws directly before being inserted, and then can be inserted so as to change their positions.

DESCRIPTION OF ACCOMPANYING DRAWINGS

SPECIFIC EMBODIMENTS

Embodiment I

Figure 3:
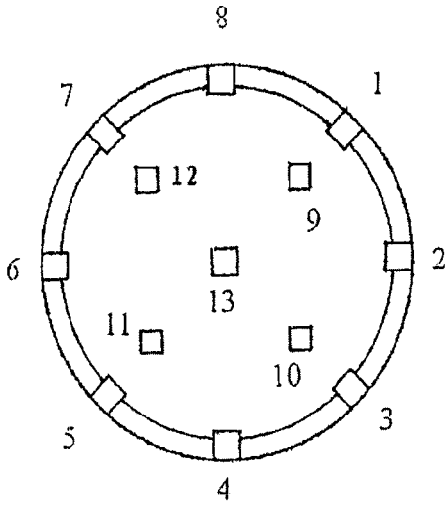
FIG. 3 illustrates a top view of a throw carrier structure according to the first embodiment of the invention.
Figure 4:
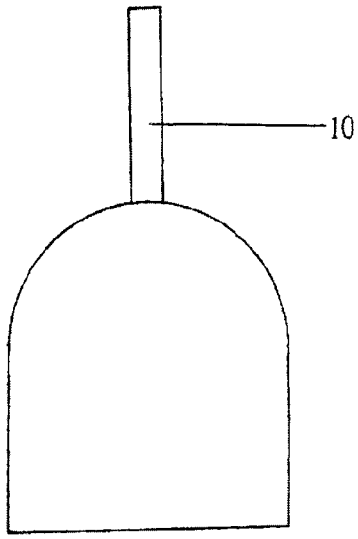
FIG. 4 illustrates a front view of a pole carrier structure according to the first embodiment of the invention.

Firstly, as illustrated in FIG. 3, 8 throws are placed at the same circumference and 5 throws on the bottom circular plane. Within the plate-shaped throw carrier, a flat cylindrical space is formed. The height of the cylinder is 0.5-1 cm, the diameter is not less than 2 cm. Secondly, as illustrated in FIG. 4, a cylinder pole is fixed on the top of the finger cap and is vertical to the sphere of the cap. The pole diameter is 0.5-1.5 mm, the height is 0.5-1.5 cm, and thus forms a pole-carrying cap which can be covered on the top part of a finger. In the end, 14 lead wires with suitable length are connected to each throw and pole. The other ends of the pole wires are connected to a column of wire pins in the form of 16×8 interface matrix. The other ends of the 13 throw wires are connected to 13 row wire pins in the 16 row lines. Thus, there forms a switch device which permits the pole to be in a state in which the pole can change its distance and direction relative to the throw before and after each contact with the throw and always moves within the circular plane and is continuously vertical to the circular plane. The switch device is associated indirectly through the rows and columns of the interface matrix to form a whole.

Example I

According to the first embodiment, 13 contact situations can be derived with one pole to 13 throws. Similar to a conventional keypad, 13 level signals are obtained. After defining the digital codes corresponding to the throws 1-10 in FIG. 3 by software, throw 11 is defined as deleting a single, throw 13 is defined as confirming, throw 12 is defined as deleting all. With the help of the digital display, only one person is allowed to view the screen, similar to watching through the cat eye on the gate. A enlarged figure of throw position defined with codes is shown aside for entering passwords by financial customers. Being small and operating without seeing, its operation enjoys considerable stealthiness.

Similarly, if the pole has only 8 contacts with throws 2, 4, 6, 8, or 9, 10, 11, 12, i.e. 8 level signals, as illustrated in FIG. 3, the corresponding definitions are directional codes, i.e. similar to the directional keys of up, down, left, and right. Two kinds of moving, i.e. on the bottom plane or on the circumference, can be selected during operation. If the wires with the same effect, i.e. 8 and 12, 6 and 11, 4 and 10, 2 and 9, are connected, only 4 wires need to be defined. The cursor on the computer can be operated by making the top of the pole or the cylinder of the pole contact the throws.

Embodiment II

Figure 6:
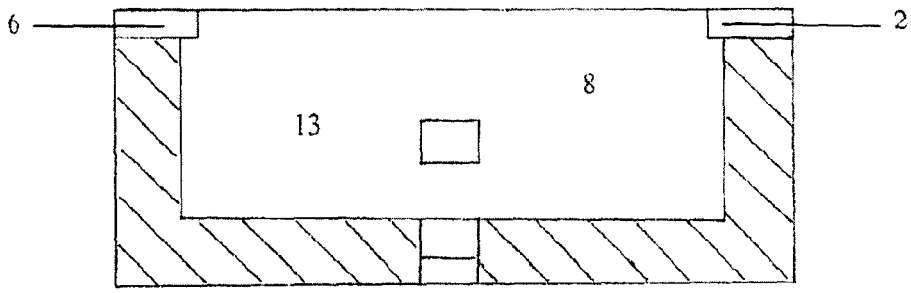
FIG. 6 illustrates a variation of a throw carrier, i.e. a sectional view of the throw carrier, according to the second embodiment of the invention.

Firstly, as illustrated in FIG. 6, only such 5 throws as 2, 4, 6, 8, 13 are employed, one is at the center of the bottom circular plane, the other 4 are at the cylinder, with respectively two throws at two levels of circumference. The lower two throws are 4 mm from the inner bottom, the height of the plate is suitable for the length of the pole.

Figure 1:
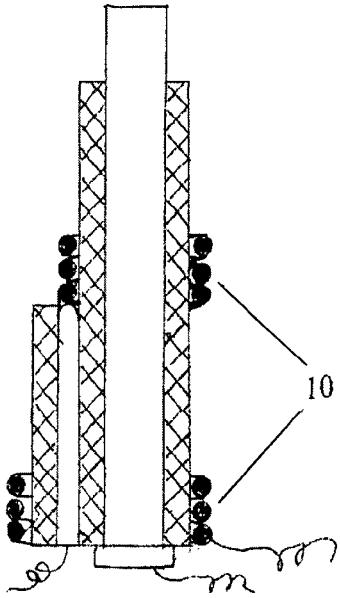
FIG. 1 illustrates the structure of the three sections of poles integrated together according to the second embodiment of the invention.

Secondly, an integral structure with 3 sections of poles is illustrated in FIG. 1, wherein the poles are insulated from each other. The manufacturing method is to paint the pole with insulating paint or cover it with a plastic pipe from the top 2-4 mm to the bottom. The thickness of the pipe wall or the paint shall not be more than 0.3 mm. A wire with paint removed and with the diameter of 0.2-0.4 mm is wound tightly from the top 4-7 mm downwards, forming a situation in which the hollow pole is sleeved outside the solid pole and both poles insulate from each other. The length of the middle pole in a pipe shape is 3-5 mm, paint is kept for the lead wire in the axis direction and the lead wire is kept insulating from the tail pole. A wire with paint removed and with the diameter of 0.2-0.4 mm is wound from 5 mm away from the middle pole, and thus forming a pole in a pipe shape similar to the middle pole, whose length is 5 mm, and paint is kept for the lead wire. The bottom end of the solid pole is fixed on the top of the finger cap and is made vertical to the sphere. The pole length should ensure that the pole can contact the throws and is easy for flexible operation when it is vertical to the circular plane and moves on the plane, and so is the size of the throw sheet.

In the end, 8 lead wires of suitable lengths are connected respectively to the 3 poles and the 5 throws at one end, and fixed on near carriers in order not to be broken. The other ends of these 8 wires are connected to the pins of interface of the controlled objects to form a switch device indirectly associated. To generate a cursor control, here the top pole and the inner bottom throw can be put aside. The lead wires of the middle pole and the tail pole are connected to one column wire. 4 throws are connected to 4 row wires, respectively, the switch device is generated after defining the directional codes. If the service object is changed, the connection with the interface also should be changed accordingly. The method is as follows.

Example II

Figure 5:
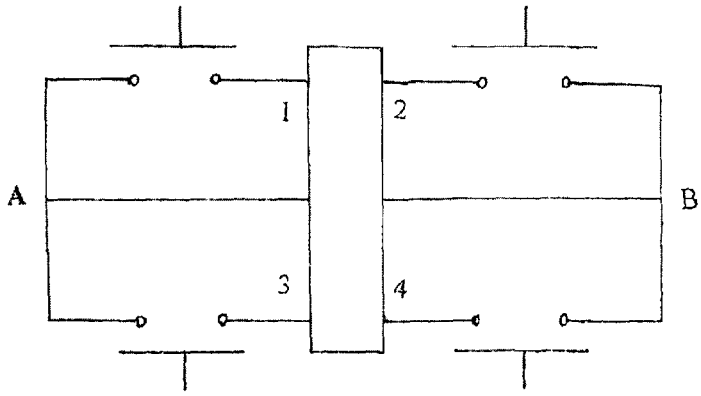
FIG. 5 illustrates the switch circuit diagram of an interface of the controlled object, i.e. a game rocker.

If the controlled object is the switch circuit of the game rocker, as illustrated in FIG. 5, the pins of the interface are situated therein, the lead wire of the tail pole is connected to point B, the lead wire of the middle pole is connected to point A. As shown in FIG. 6, the throws at positions 4, 8, 2, 6 are connected to pins 2, 4, 1, 3 respectively to form the function of controlling a game direction. The top pole and the inner bottom throw form a confirm switch, the interfacing pin of its lead wire is not shown in this figure. But it does not affect a complete disclosure of the invention since it is in the prior art. This example shows that the switch device of the present invention is made to have an indirect associated whole by controlling the controlling circuit of a rocker. It also shows that different service objects make the elements in the switch device varied.

Example III

Figure 7:
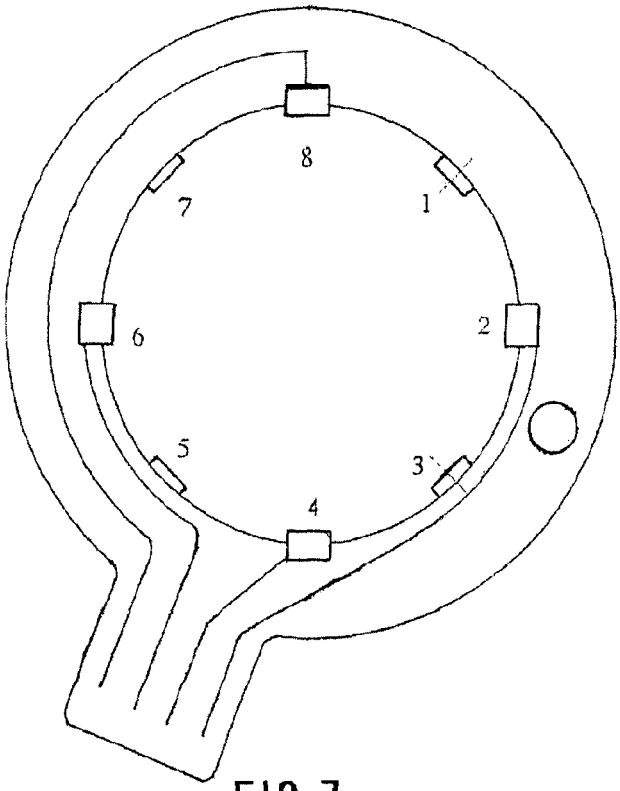
FIG. 7 illustrates a derivation of a throw carrier, i.e. a circular front view of the circular sheet, according to the second embodiment of the invention.

Firstly, as shown in FIG. 7, eight throws are uniformly placed on the same circumference in a state that one positive throw alternate with one inverse. The throw carrier is in a circular sheet shape, the inner circle shows a circular plane space with no barrier. The lead wires of both the positive throws and the inverse throws are attached onto the front and opposite planes of the circular carriers at the hub point. It is similar to the matrix layout of a computer keypad attaching onto a plastic sheet. The arc length of the inner circle occupied by the throw sheet is such that the distance between two adjacent throws is maximized and they cannot contact each other. Here the throw width is 1-2 mm, the length is 3-5 mm. The thickness of the circular sheet is 0.5-1 mm, the inner circle is not thicker than the forefinger, and the outer circle is not wider than two fingers. The extending stick between the throw 4 and the throw 5 is provided for wiring and is inserted into a hub where 8 lead wires have one end fixed therein. A small hole is arranged near the outer circle and between the throw 2 and the throw 3 for positioning and connecting when not in use or during operation. The annular sheet can be held at the outer circle by the left hand or fixed by inserting at a position convenient for the right hand to move the pole.

Secondly, a structure of the finger cap with pole, in which 3 poles are integrated together as shown in example II, is employed. Synchronous moving with the single finger and moving in a circular plane spatially with no barrier can be ensured, and it is maintained vertical to the circular plane during continuous operation. It has shown the dynamic feature that the direction and interval of the pole relative to the throw are changed before and after contacting the throw each time. It can also be seen that it can be fully ensured that the pole can be inserted into and drawn out of the inner circle of the annular sheet, i.e. it is possible that the pole spatially moves vertical to the circular plane. By means of such possibility, a smaller pole is moved vertically to achieve the function that 3 poles can changeably contact 8 throws. There will be 3×8=24 types of throw contacting possibilities, i.e. it means that 24 levels can be generated to define codes.

In the end, the 3 poles are connected to lead wires, which are of suitable length and fixed in the hub, and are continuously extended to connect to the pins of the 3 column wires of an interface matrix. The other ends of the 8 throw lead wires, which had been connected to the hub, are connected to the pins of the 8 row wires of the matrix. For the 24 level signals thus generated, the middle pole contacting the 8 throws can be defined by the audio card or other electroacoustical software as accordatura C, D, E, F, G, A, B musical scale plus a higher octaves scale and a lower octaves scale. The top pole contacting the 8 throws can be defined as high octaves scale, an additional one can be defined as one of a low octaves scale and a further higher octaves scale. The tail pole contacting the 8 throws is low octaves scale, an additional one is treated as above. Thereby electroacoustical performance in computer multimedia can be done. If it is desirable to define more functional enjoyment, another same throw carrier can be made integrated on a plane by fixing and connecting two annular sheets via a small hole arranged between the throw 2 and throw 3 and near the outer circle, the pole can be repeatedly inserted into or drawn out of two annular sheets. The newly generated 24 level signals are defined optionally according to needs. From this example it can be seen that with an increase of the amount of the elements such as throws and poles of the switch device, multiple increase of the categories of level signals can be obtained, this means that the range of application of the switch device has a potential of being expanded.

Example 4

If the feature that moving throws within the one plane is combined to the existing feature that the pole in the keypad contacts the throw vertically at a constant interval, the minimization and moving without seeing can be demonstrated in another way.

The manufacturing method is: firstly 9 poles and 9 throws are arranged in matrix, as normal square, respectively, the 18 contact points (both poles and throws are set in a thin, flat, and small form) and respective lead wires are attached inside the 0.3 mm thin plastic sheets, the plastic sheets are the carriers of poles and throws. The throw carrier is bigger than the pole carrier, the size of the carrier attached to the pole is similar to an adult's nail, being in a square shape.

Secondly, 18 lead wires are connected to one end of suitable length. The other ends of the wires are connected correspondingly to the pins of the row line and column line of the matrix of the interface to generate 9 common level signals. Here, the switch device has been completed in terms of structure, but in practical application, however, it is possible to generate another 36 types.

In the end, the total 45 possible level signals are assigned with definitions based on the requirement.

Figure 2:
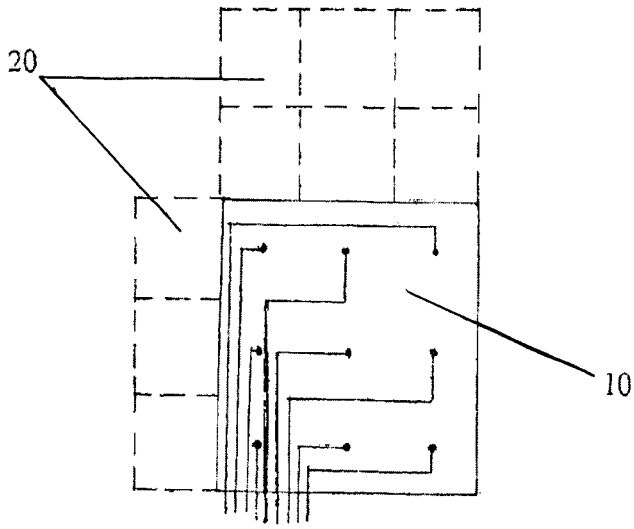
FIG. 2 illustrates the visual scenarios of the signal generation by the invention in combination with the existing switch technique.

The signals are generated as follows: One face of a pole carrier and a throw carrier is made with higher friction force to some extent than the other face. During operation the two sheets are lapped over with the rubbing surfaces facing outside. Then, they are pinched by the thumb and the forefinger side at a suitable position, thereby resulting in a form that the sheet adheres to the skin. The pole can be pushed by the thumb towards one of the 9 throws in a square to generate a signal, and it is also true for the other 8 throws. If the pole carrier is slightly slipped by the thumb to a place shown by the dotted line on the left side in FIG. 2, and then is pressed and selected by the thumb, 6 new level signals will be generated. As shown in FIG. 2, the pole carrier can be slipped slightly to the upper dotted line to further generate 3 level signals. Actually 9 kinds of level signals can be generated if it is slipped towards one direction shown in this figure to a desired position. So, it is conceivable that 4×9=36 types of situations for contacting the throw forcibly by the thumb can be generated if the pole carrier is slipped in four directions, i.e. up, down, left and right. Plus 9 at the original positions, in total 5×9=45 kinds of level signals can be generated for defining required codes. If capacitance switch is not employed, small holes can be made on the attached films of the pole and the throw for operating to touch. If the throw carriers are expanded to 3 throws respectively in four directions, 12 signals can be generated by moving the poles one row outward, and 36 signals for 3 rows, plus 45 that will be a total of 81=9×9. If the throws are expanded further so that throws will be arranged fully at the crisscross corner space, another 36 signals can be generated. It can be seen that this is a derivation and multiplication process. Existing integration technique can be utilized in this example to combine the 100 lines into one.

The invention claimed is:

1. A method of manufacturing a switch device, said method comprising:

arranging more than two throws on the same plane of a cylindrical throw carrier, said plane being substantially perpendicular to the vertical axis of said cylindrical throw carrier;

fixing said throws on the inner surface of said throw carrier on said same plane;

fixing at least one pole on the top of a pole carrier having a cap shape that can be worn on the tip of a single human finger;

connecting one end of each a plurality of throw lead wires to respective said throws;

connecting one end of a pole lead wire to said pole; and connecting the other end of said throw and pole lead wires to an interface of a controlled object in order to form said switch device, whereby distances between said throws and said pole are variable, and whereby contact between said pole and one of said throws operates said switch device.

2. The method according to claim 1, further comprising:

inserting said pole on said pole carrier into said cylindrical throw carrier, wherein the pole is freely movable within the plane and is vertical to the plane.

3. The method according to claim 1, wherein the throws and the pole are expandable on the carrier plane.

4. The method according to claim 3, wherein changing functions of the poles and throws enable multiple types of throw contacting.

5. The method according to claim 1, wherein the number of the poles, the throws and the carriers can be increased.

6. The method according to claim 1, wherein the pole carrier and the throw carrier are an integrated structure or are separate structures.

7. The method according to claim 6, wherein said pole carrier includes three poles in an integrated structure.

8. The method according to claim 1, wherein the size and shape of said pole, said throws and said carrier are variable and selectable, and wherein the code definition of pole-throw contact type are variable and selectable.

9. The method according to claim 1, wherein said switch device is suitable for interfaces requiring a man-made real-time response.

10. The method as recited in claim 1 wherein said throws are arranged uniformly about said inner surface of said throw carrier.

11. The method as recited in claim 1 wherein said throw carrier has an annular shape or a concave shape.

12. The method as recited in claim 1 wherein said pole has a cylindrical shape.

* * * * *